United States Patent [19]

Engel

[11] 4,108,396

[45] Aug. 22, 1978

[54] BOBBIN FOR TEXTILE YARNS OR THE LIKE

[76] Inventor: Adalbert Engel, Drosselweg 4, Lörrach, Fed. Rep. of Germany, 7850

[21] Appl. No.: 656,713

[22] Filed: Feb. 9, 1976

[30] Foreign Application Priority Data

Feb. 15, 1975 [DE] Fed. Rep. of Germany ..... 2506512

[51] Int. Cl.[2] ..... B65H 75/20

[52] U.S. Cl. ..... 242/118.11

[58] Field of Search ..... 242/118.11, 118.2, 118.1, 242/118; 68/198, 189; 138/178, 121, 122, 120

[56] References Cited

U.S. PATENT DOCUMENTS

| | | | |
|---|---|---|---|
| 974,127 | 11/1910 | Daniell et al. | 242/118.11 |
| 1,966,152 | 7/1934 | Taylor | 242/118.11 |
| 3,313,319 | 4/1967 | Osborn et al. | 138/121 |
| 3,330,303 | 7/1967 | Fochler | 138/121 |
| 3,563,491 | 2/1971 | Hahm et al. | 242/118.11 |
| 3,640,312 | 2/1972 | Bauman et al. | 138/121 |
| 3,658,097 | 4/1972 | Martin et al. | 138/178 |
| 3,715,454 | 2/1973 | Kleykamp | 138/121 |
| 3,827,652 | 8/1974 | Burchette | 242/118.11 |
| 3,936,009 | 2/1976 | Livingstone | 242/118.11 |

FOREIGN PATENT DOCUMENTS

| | | | |
|---|---|---|---|
| 661,567 | 6/1938 | Fed. Rep. of Germany | 242/118.11 |

*Primary Examiner*—George F. Mautz
*Attorney, Agent, or Firm*—Peter K. Kontler

[57] ABSTRACT

A bobbin for a roll of coiled filamentary textile material has a tubular body which includes circumferentially extending larger-diameter sections alternating with smaller-diameter sections. At least some of the sections are plastically and/or elastically deformable so as to allow for predictable axial shortening and/or reduction of the outer diameter of the roll. The tubular body is permeable to liquids so that a dye or the like can permeate the roll from the outside as well as from within. The sections may constitute convolutions of a helix or discrete rings, and at least the larger-diameter sections may be hollow. The sections may form part of a corrugated tube or they may surround a rigid core whose inner diameter remains constant during axial and/or radial compression of the roll.

19 Claims, 11 Drawing Figures

BOBBIN FOR TEXTILE YARNS OR THE LIKE

BACKGROUND OF THE INVENTION

The present invention relates to bobbins or spools for textile yarns or the like. More particularly, the invention relates to improvements in bobbins or spools which perferably consist, at least in part, of synthetic thermoplastic material and constitute hollow cones or cylinders. Such bobbins are used to support rolls consisting of textile yarns or other filamentary material during wet- and/or heat-treatment in a dyeing plant or the like.

It is desirable that the bobbins should be capable of elastic deformation in the axial direction thereof and that the bobbins should also be capable of undergoing elastic deformation in the radial direction thereof, at least in the course of heat-treatment of filamentary material. At the same time, the configuration of the bobbins, especially their inner diameter, should undergo a negligible change or should remain constant.

Presently known bobbins or spools which are used to store rolls consisting of coiled textile yarns or the like during wet- and/or heat-treatment are usually smooth-surfaced hollow cylinders or cones which are perforated or constitute a lattice-work with a large number of apertures for the circulation of a fluid treating medium. Reference may be had to German Auslegeschrift No. 1,635,118. A simple bobbin which is merely provided with perforations is often incapable of exhibiting satisfactory deformability in the course of wet- and/or heat-treatment of yarns. On the other hand, a bobbin whose body is a latticework is incapable of withstanding appreciable radial stresses without permanent deformation and/or excessive change in its configuration.

Another serious drawback of presently known perforated or sieve-like bobbins is that their manufacturing cost is too high and that their versatility is unsatisfactory. Thus, the construction of a large-diameter bobbin is quite different from that of a smaller-diameter bobbin. This, too, contributes to the manufacturing cost and creates problems in connection with storage of different types of bobbins.

SUMMARY OF THE INVENTION

An object of the invention is to provide a novel and improved bobbin or spool which exhibits a highly satisfactory elasticity or deformability in the radial and/or axial direction thereof while, at the same time, offering a substantial resistance to permanent deformation and/or appreciable changes in its configuration.

Another object of the invention is to provide a bobbin or spool of the just outlined character which is especially suited to support coiled textile yarns or the like during wet- and/or heat-treatment of such commodities and is capable of conforming to changes in the physical characteristics of yarns during treatment by heat and/or a liquid conditioning agent.

A further object of the invention is to provide a simple bobbin or spool which can be mass-produced at a relatively low cost and whose versatility greatly exceeds that of conventional bobbins.

The invention is embodied in a bobbin or spool, particularly a cylindrical and/or conical bobbin for heat- and/or wet-treatment of textile yarns or the like which consists, at least in part, of a suitable synthetic thermoplastic material.

In accordance with the invention, the bobbin comprises a one-piece or composite tubular body at least a portion of which is plastically and/or elastically deformable in the radial and/or axial direction of the bobbin while the configuration of the internal surface of the body remains at least substantially unchanged. The tubular body has substantially circumferentially extending larger-diameter sections and smaller-diameter sections which alternate with each other, as considered in the axial direction of the bobbin.

The larger-diameter and smaller-diameter sections of the tubular body may constitute convolutions of a helix, or circumferentially complete rings. If the sections constitute portions of a helix, the tubular body of the bobbin perferably further includes a substantially rigid cylindrical, conical or partly cylindrical and partly conical hollow core which is surrounded by the helix and is but need not be bonded to the smaller-diameter and/or larger-diameter sections.

The novel features which are considered as characteristic of the invention are set forth in particular in the appended claims. The improved bobbin itself, however, both as to its construction and the mode of making and utilizing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
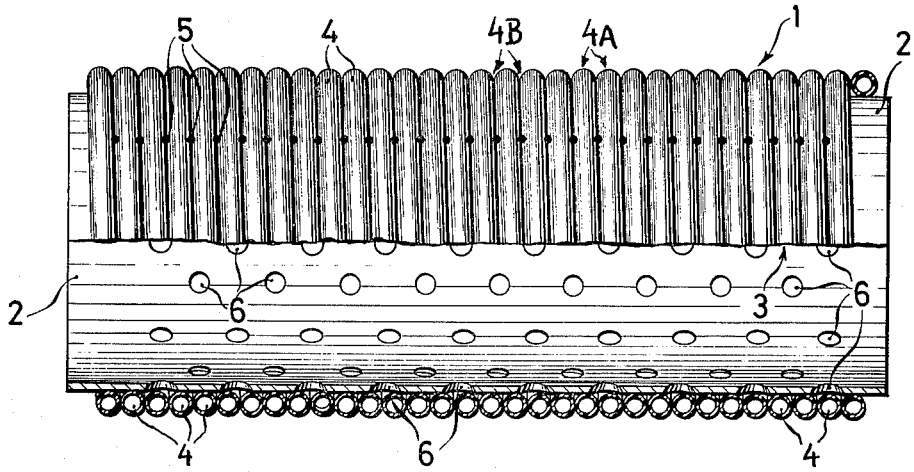
FIG. 1 is a schematic partly elevational and partly axial sectional view of a first bobbin which embodies the invention.

Referring first to FIG. 1, there is shown a bobbin or spool 1 which is a hollow tubular body including a rigid or substantially rigid cylindrical core 2 and an elastically deformable envelope 3. The envelope 3 consists of synthetic thermoplastic material and surrounds the external surface of the core 2. The core 2 has a plurality of circular or otherwise configurated radially extending openings or apertures 6 so that, when the filamentary material (hereinafter called yarn for short) is coiled around the envelope 3, it can be contacted from all sides by a fluid (e.g., a liquid) which is introduced into the interior of the core 2 and is also caused to contact the exterior of the roll of yarn on the envelope.

The convolutions 4 of the envelope 3 form a helix, and the neighboring convolutions 4 of such helix are connected to each other, as at 5. The manner of connecting the neighboring convolutions 4 to each other can be selected at will; it is presently preferred to resort to a welding or bonding procedure so that each of the points 5 is a weldant or weld securing the respective convolutions to each other. The welds 5 may form a row extending in parallelism with the axis of the core 2. The neighboring convolutions 4 of the envelope 3 may be connected to each other at a single point (as shown in the upper half of FIG. 1) or at two or more points, as considered in the circumferential direction of the core, i.e., such welds can form two or more rows parallel to the axis of the core 2.

The apertures 6 may be formed at random or in accordance with a predetermined pattern; preferably in such a way that each unit area of the core 2 is formed with a predetermined number of apertures. The apertures 6 may but need not be of identical size and/or shape.

In the embodiment of FIG. 1, the core 2 is a circular cylinder having a constant diameter from end to end. However, it is equally within the purview of the invention to use a bobbin which comprises a hollow conical core or a core which is partly conical and partly cylindrical. This applies for all embodiments of the improved bobbin.

The median portions of the convolutions 4 constitute larger-diameter sections and the outer portions of the convolutions 4 constitute smaller-diameter sections of the envelope 3. The larger-diameter sections alternate with the smaller-diameter sections, as considered in the axial direction of the bobbin 1, and the sections extend in the circumferential direction of the core. The larger-diameter sections of the envelope 3 are indicated at 4A, and the smaller-diameter sections are indicated at 4B. It will be noted that each section 4B includes at least one weld 5.

The tubular body of the bobbin 1 is a composite structure because it consists of two main parts, namely the core 2 and the envelope 3. An important advantage of the bobbin 1 is that it exhibits a highly satisfactory stability. At the same time, the tubular body of the bobbin 1 is capable of yielding, at least in part, during heat- and/or wet-treatment of a roll of yarn which is coiled onto and surrounds the envelope 3. Moreover, the envelope allows for highly satisfactory winding or unwinding of yarns. The two main parts of the bobbin can be mass-produced at a relatively low cost, for example, by resorting to an extrusion, blowing or deep-drawing technique. This is important since such bobbins are produced in large quantities so that any, even minute savings in material, time or both contribute significantly to the lower cost of the bobbins. Since the sections 4A and 4B extend substantially circumferentially of the core 2, they do not interfere with but actually promote a highly satisfactory coiling or unwinding of the yarn. The cylindrical core 2 enhances the stability of the bobbin even if its wall is extremely thin so that the bobbin can stand, without any danger of collapsing, substantial radial stresses which can arise while the yarn shrinks so that the outer diameter of the roll of yarn on the envelope 3 decreases. It has been found that, especially when the envelope 3 consists of an elastically deformable synthetic thermoplastic material, its ability to yield in response to shrinkage of the coiled yarn is much more pronounced than that of the aforediscussed conventional bobbins whose tubular body is a latticework or a perforated smooth-surfaced cylinder.

The making and convoluting of the envelope 3 around the core 2 contributes relatively little to the manufacturing cost of the bobbin 1. If desired, the one-piece tube which is converted into the envelope 3 can be replaced by a series of discrete ring-shaped components which are slipped onto the core 2 so that they form a stack of abutting rings which can be connected to each other by one or more rows of welds 5 or the like.

The envelope 3 can be held in requisite position on the core 2 by providing the external surface of the core and/or the inner sides of the convolutions 4 with suitable projections and/or sockets (e.g., circumferential grooves and/or ribs, not shown).

Figure 2:
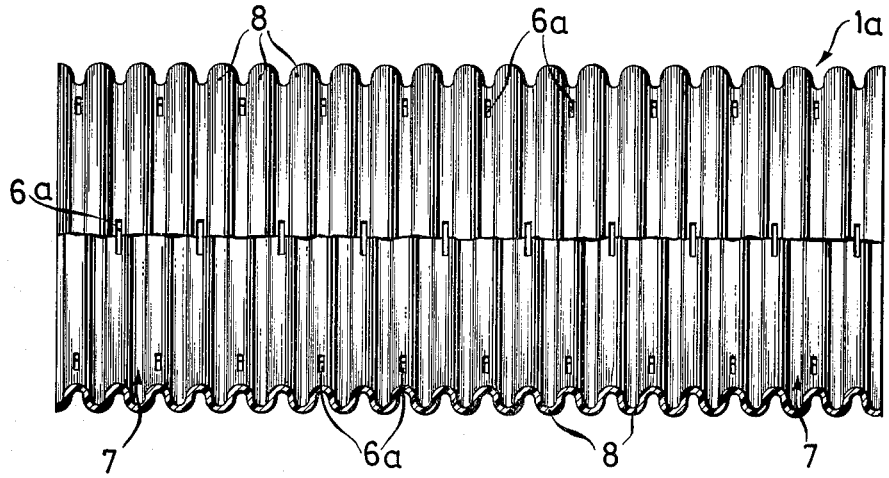
FIG. 2 is a similar partly elevational and partly sectional view of a second bobbin.

FIG. 2 shows a modified spool or bobbin 1*a*. This bobbin has a one-piece tubular body which is undulate (meandering) or corrugated and consists of alternating larger- and smaller-diameter sections 8 and 7 so that its exterior exhibits a profile similar to the profile of the envelope 3 of FIG. 1. It can be said that the tubular body of the bobbin 1*a* resembles a bellows. The wall thickness of the tubular body is substantially constant; thus, the larger-diameter sections 8 are hollow on the inside and their thickness (see the lower half of FIG. 2 which is an axial sectional view of the envelope) is the same as that of the smaller-diameter sections 7.

The flow of a fluid treating medium through the tubular body of the bobbin 1*a* is facilitated by the provision of apertures or openings 6*a* which are shown in the form of elongated slots machined into the smaller-diameter sections 7 and extending in the circumferential direction of the bobbin 1*a*. Each section 7 may have one, two or more apertures 6*a* which are spaced apart from each other, as considered in the circumferential direction of the tubular body. The sections 7 and 8 are circumferentially complete rings or annuli which alternate with each other, i.e., each section 7 is flanked by two sections 8 and vice versa. The tubular body of the bobbin 1*a* may but need not include a cylindrical core. The absence of a core contributes to radial and/or axial deformability of the tubular body shown in FIG. 2.

Figure 3:
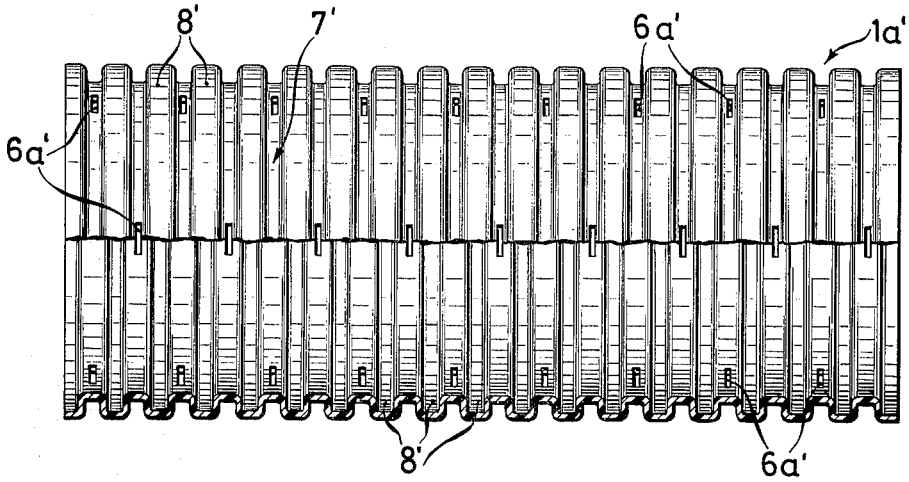
FIG. 3 is a similar partly elevational and partly sectional view of a third bobbin.

The bobbin or spool 1*a*′ of FIG. 3 is practically identical with the bobbin 1*a* of FIG. 2. The only important difference is that the neighboring sections 7′ and 8′ of the tubular body of the bobbin 1*a*′ have a polygonal cross-sectional outline. The uniform wall thickness of the meandering tubular body is shown in the lower part of FIG. 3 which illustrates the bobbin 1*a*′ in axial section.

In each of the bobbins shown in FIGS. 2 and 3, the larger-diameter sections 8 or 8′ flank circumferentially complete grooves which surround the smaller-diameter sections 7 or 7′.

Figure 7:
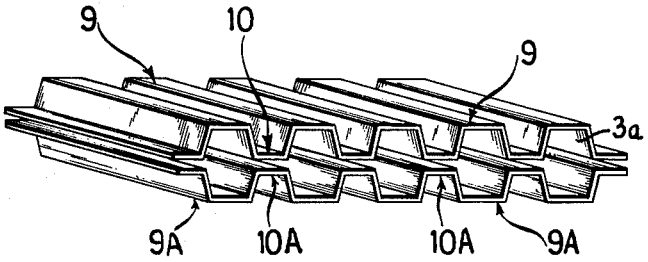
FIG. 7 is a fragmentary perspective view of a blank which is convertible into a bobbin similar to that shown in FIG. 3.
Figure 8:
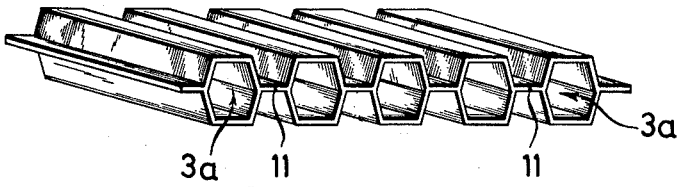
FIG. 8 is a fragmentary perspective view of a slightly modified blank which can be converted into a bobbin similar to that shown in FIG. 3.
Figure 9:
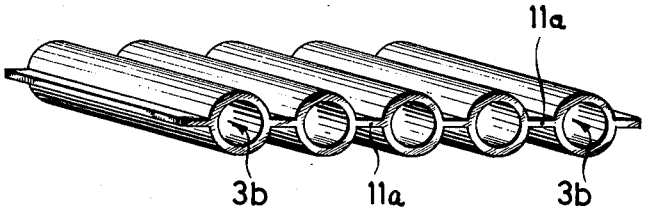
FIG. 9 is a fragmentary perspective view of a blank which is convertible into a bobbin resembling the bobbin of FIG. 2.

FIGS. 7, 8 and 9 show portions of blanks adapted to be converted into tubular bodies of bobbins or spools which constitute modifications of the bobbins 1*a* and 1*a*′. The blank of FIG. 7 can be converted into the tubular body of a bobbin which resembles the bobbin 1*a*′ because the larger-diameter sections 9 of the bobbin obtainable from the blank of FIG. 7 have a polygonal cross-sectional outline. The smaller-diameter sections 10 are relatively narrow webs which connect neighboring sections 9 to each other. The bobbin which can be obtained from the blank of FIG. 7 further comprises second smaller-diameter sections 9A and second larger-diameter sections or webs 10A. Each section 9A is in register with one of the sections 9, and each section or web 10A is in register with one of the sections or webs 10. The blank of FIG. 7 can be made of a suitable synthetic plastic material, preferably by resorting to an extrusion molding technique. The sections or webs 10, 10A are welded or otherwise bonded to each other, preferably before the blank is converted into a bobbin or spool similar to that shown in FIG. 3. The thus obtained bobbin comprises ring-shaped cells 3*a* each having a hexagonal cross-sectional outline and each including a section 9 and a section 9A, as well as ring-shaped webs each including a web 10 and a web 10A. If desired, and as shown in FIG. 8, the thermoplastic material can be extruded in such a way that the cells 3*a* and webs 11 are formed during extrusion. When the blank of FIG. 8 is converted into a bobbin, it is practically identical with the bobbin which can be obtained by converting the blank of FIG. 7 into a tubular body. In fact, the blank of FIG. 8 may constitute that blank which is obtained by welding the registering webs 10, 10A of FIG. 7 to each other.

The blank of FIG. 9 resembles the blank of FIG. 8. The only difference is that the hexagonal cells 3*a* of the blank of FIG. 8 are replaced with cells 3*b* having a circular cross-sectional outline. The webs which connect the neighboring cells 3*a* to each other are shown at 11*a*. The webs 10, 10A, 11 and 11*a* may be and preferably are formed with apertures (not shown in FIGS. 7–9) which allow a liquid treating medium to penetrate into the inner side of a roll of yarn which is coiled onto the bobbin adapted to be obtained by converting the blank of FIG. 7, 8 or 9 into a tubular body. The blanks are preferably rectangular and are coiled to form cylinders with abutting marginal portions which are welded to each other to resemble tubular bodies of the type shown in FIG. 2 or 3.

Figure 6:
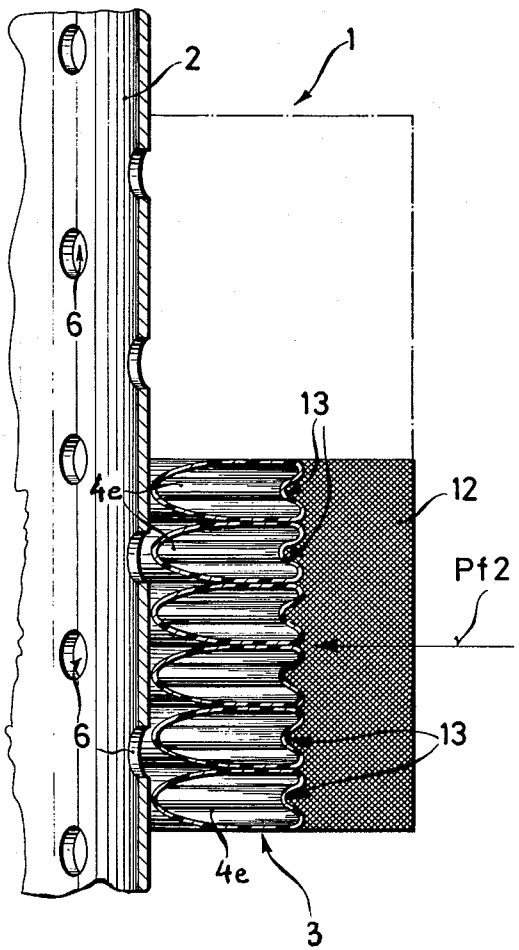
FIG. 6 shows the structure of FIG. 5 but with the roll of yarn shrunk so that its outer diameter is less than the outer diameter of the roll shown in FIG. 5.
Figure 5:
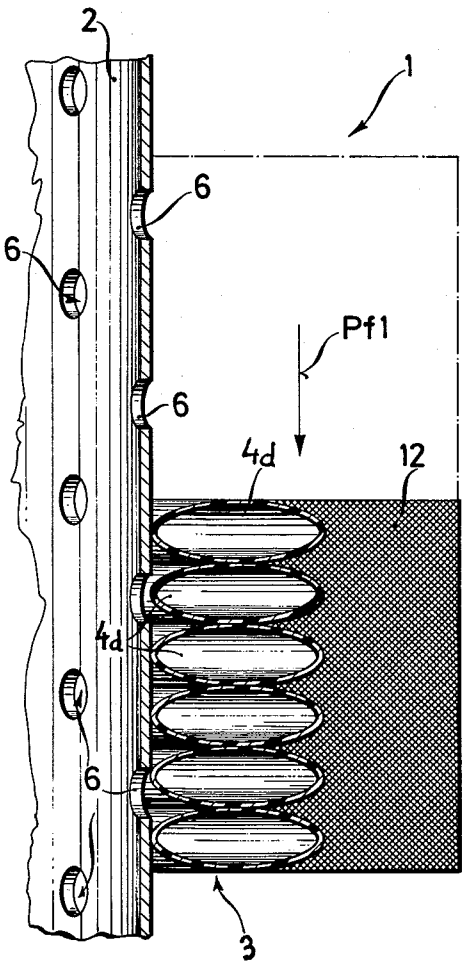
FIG. 5 shows the structure of FIG. 4 but with the roll of yarn compressed in the axial direction of the bobbin.
Figure 4:
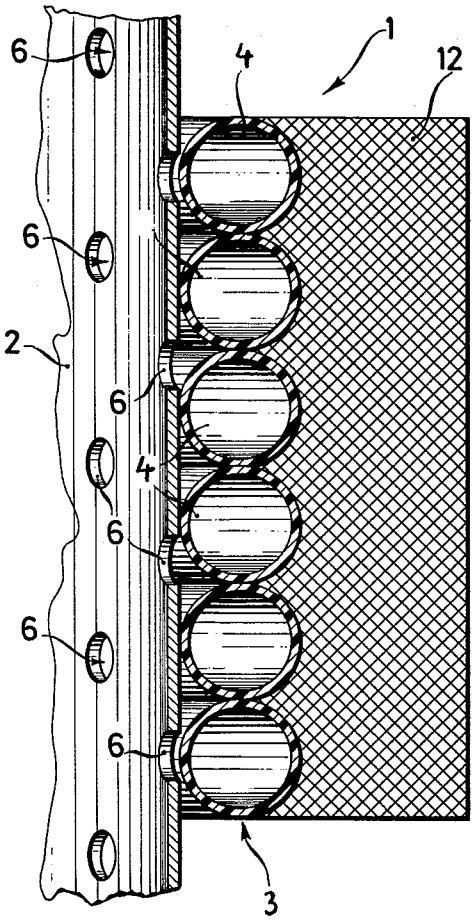
FIG. 4 is an enlarged fragmentary axial sectional view of the first bobbin, further showing a roll of textile yarn which is convoluted on the bobbin.

Various phases or stages of treatment of a roll 12 of yarn which is coiled onto the bobbin 1 of FIG. 1 are shown in FIGS. 4, 5 and 6. Such treatment may include contacting the yarn with a liquid, heating or cooling the yarn, subjecting the yarn to tensional stresses, causing the coils of the yarn to shrink and/or others.

The envelope 4 of the bobbin 1 consists of tubular synthetic plastic material which forms a series of convolutions together constituting a helix or a series of rings which are immediately or closely adjacent to each other. The roll 12 surrounds the envelope 3 and has a substantially constant outer diameter.

It is assumed that the bobbin of FIGS. 4 to 6 is mounted in a dyeing apparatus having a suitable metallic carrier or support which extends into the interior of the core 2. The roll 12 may constitute a single length of convoluted filamentary material or two or more shorter rolls which are placed end-to-end. The roll 12 is thereupon subjected to a mechanical compressing or shortening action by applying thereto a force Pf1 acting in parallelism with the axis of the core 2. The axial length of the roll 12 is thereby reduced (e.g., in half) and the hollow convolutions 4 of the envelope 3 are deformed, i.e., each convolution 4 originally having a circular outline (FIG. 4) is converted into a convolution 4*d* having an oval cross-sectional outline (FIG. 5). Such deformation of convolutions 4 does not affect the connection between the shortened roll 12 and the bobbin; on the contrary, the oval convolutions of FIG. 5 enhance the ability of the bobbin to retain the shortened roll 12 in an optimum position with respect to the core 2. The readily deformable convolutions of the envelope 3 do not interfere with a shortening (and attendant reduction of volume) of the roll 12. Also, the conversion of round convolutions 4 into oval convolutions 4*d* results in uniform tensioning of all coils of the roll 12.

The roll 12 is thereupon subjected to a wet and/or heat treatment, e.g., to treatment with a liquid which is caused to flow from the interior of the core 2, through the apertures 6, between the convolutions 4*d* and into the shortened roll 12 of FIG. 5, as well as against the exposed surface of the roll. The liquid can flow into and from the interior of the core 2.

A wet- and/or heat-treatment of the roll 12 may include additional deformation of convolutions of the envelope 3, e.g., in a manner as shown in FIG. 6. The additional treatment involves a shrinkage of the yarn (e.g., a synthetic plastic yarn) whereby the roll 12 subjects the envelope 3 to the action of forces Pf2 acting radially of and toward the axis of the core 2. Thus, the outer diameter of the roll 12 is reduced whereby the roll 12 deforms the convolutions 4*d* of the envelope 3 by causing each such convolution to assume the shape shown (at 4*e*) in FIG. 6. The outer portion of each convolution 4*e* is formed with a circumferentially extending groove or recess 13. The readily deformable material of the convolutions 4, 4*d* insures that the distribution of stresses in each coil of the roll 12 is uniform or nearly uniform, not only during conversion of the relatively long roll 12 of FIG. 4 into a shorter roll (FIG. 5) but also during conversion of the shorter roll into the smaller-diameter roll shown in FIG. 6. The last mentioned conversion does not involve any or involves only a negligible reduction of the inner diameter of the bobbin 1 so that the core 2 can be readily removed from the aforementioned metallic carrier or support upon completion of treatment shown in FIGS. 4 to 6. The bobbin 1 is then transferred to another station (e.g., to an unwinding station) where the length of its core can be reduced, without any waste, so as to compensate for shortening of the roll 12.

The utilization of synthetic thermoplastic material in the making of envelope 3 is especially desirable when the yarn forming the roll is subjected to heat-treatment. Thus, the material of the envelope 3 can be readily selected in such a way that it is elastic at normal temperature and is not only elastic but also plastically deformable in response to heating.

The convolutions 4 of FIGS. 4–6 can be replaced by a stack of discrete rings similar to the elements 3*b* of FIG. 9.

Figure 10:
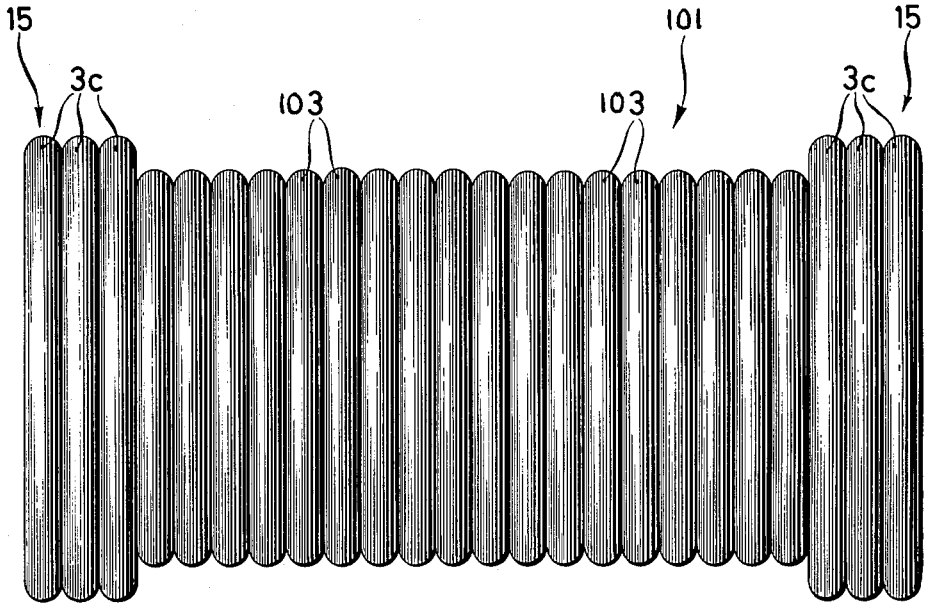
FIG. 10 is a side elevational view of a further bobbin.

Satisfactory winding of certain types of yarns necessitates the utilization of bobbins having portions with different outer diameters. One such bobbin 101 is shown in FIG. 10. The major portion of the bobbin 101 consists of or comprises discrete rings 103 or a helically convoluted tube which is flanked by discrete rings or larger-diameter convolutions 3*c* which are adjacent to the respective ends 15 of the bobbin. The bobbin 101 of FIG. 10 may be constructed and assembled in a manner somewhat similar to that of the bobbin 1 shown in FIG. 1. Thus, the core 2 of FIG. 1 can be replaced with a core having a smaller-diameter central portion surrounded by the rings or convolutions 103 and two larger-diameter end portions surrounded by the larger-diameter convolutions 3*c*. The convolutions 103 and 3*c* are preferably hollow tubes which, together with the just-discussed core, form a composite hollow tubular body.

Figure 11:
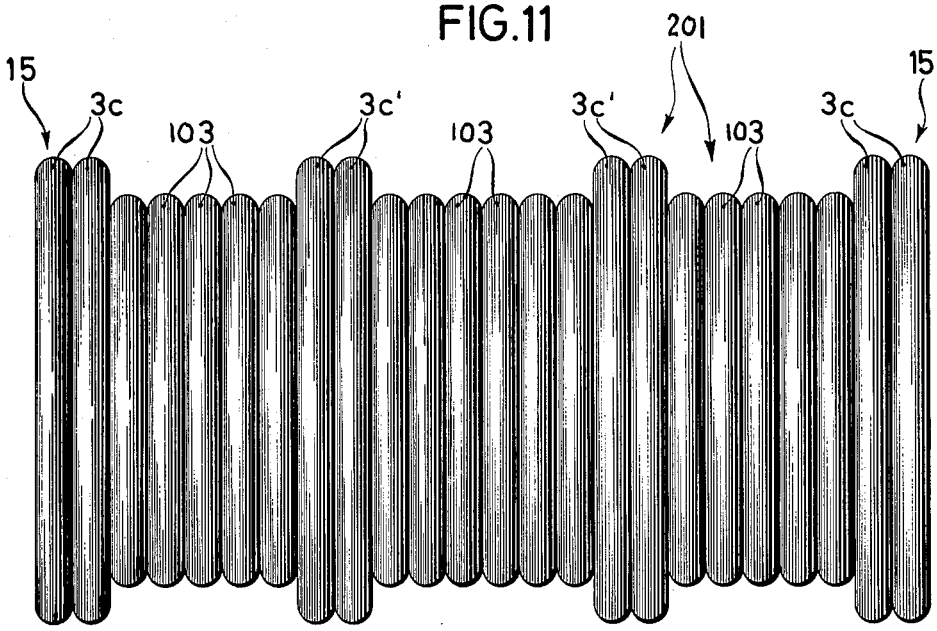
FIG. 11 is a side elevational view of still another bobbin.

The bobbin or spool 201 of FIG. 11 constitutes a modification of the bobbin 101. The bobbin 201 includes larger-diameter coils or rings 3*c* at both axial ends 15 as well as larger-diameter rings or convolutions 3*c*′ intermediate the ends 15. The number of coils 3*c* at the ends 15 can be reduced to two or one or increased to four or more. The same applies for the coils 3*c*′ intermediate the ends 15 of the bobbin shown in FIG. 11.

It is further within the spirit of the invention to replace the hollow rings or convolutions 3, 103, 3*c* and/or 3*c*′ with elongated cord-like elements which consist of foamed synthetic plastic material. Such cord-like elements can be interwoven or interlaced with each other in criss-cross fashion to form a deformable network which surrounds a relatively rigid core. The loci of intersection of cords can include loops or knots, and the intersecting cords may extend at right angles or at an oblique angle to each other.

It is normally preferred to design the tubular body of the improved bobbin or spool in such a way that it is capable of undergoing deformation, at least in the radial direction of the bobbin, without appreciable change of the inner diameter. However, it is also within the purview of the invention to utilize a bobbin which exhibits some or all of the aforediscussed features and is further designed to undergo at least some change (reduction) of its inner diameter in response to stressing in the direction indicated by arrow Pf2 shown in FIG. 6. As stated above, the tubular body of the improved bobbin may be a straight circular cylinder, a hollow cone or a tubular body which is partially cylindrical and partly conical. For example, and referring to FIG. 1, the diameter of the core 2 may increase in a direction from the right to the left, from the left to the right, from the left (or the right) toward the center or from the right and left toward the center so that the tubular body is a cone having a base at the right- or left-hand end of the bobbin, a twin cone whose maximum-diameter portion is located midway between the ends of the bobbin, or a tubular body one half of which is a cylinder and the other half of which is a cone. Alternatively, the conical configuration may be imparted by using a coiled tube (which forms the envelope 3) whose diameter decreases from the one toward the other end thereof and by convoluting such tube on a cylindrical core. Additional modifications include combining one or more features of the bobbin of FIG. 1 with one or more features of the bobbin of FIG. 2, 3, 7, 8, 9, 10 and/or 11. The core 2 of the bobbin 1 and the envelope 3 shown in FIG. 1 and also the other bobbins here described may be made of a thermoplastic material such as polypropylene, polyethylene or another polyolefin, a polyamide, polyvinylchloride (PVC) or other material with similar physical properties. It is also possible utilize a thermosetting polymer such as a resin-rubber.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed is:

1. A bobbin for heat- and/or wet-treatment of textile yarns or the like, comprising a hollow liquid-permeable tubular body at least a portion of which consists of synthetic plastic material and at least a portion of which is elastically deformable in radial and axial directions thereof without appreciable changes in the configuration of the internal surface of said hollow body, said body having substantially circumferentially extending alternating abutting larger-diameter and smaller-diameter sections, each of said larger-diameter sections being a circumferentially complete section.

2. A bobbin as defined in claim 1, wherein at least some of said sections are rings.

3. A bobbin as defined in claim 1, wherein said tubular body is corrugated and said larger-diameter sections flank circumferentially complete grooves surrounding said smaller-diameter sections.

4. A bobbin as defined in claim 1, wherein said tubular body is a deformed blank of extruded profiled material.

5. A bobbin, particularly for heat- and/or wet-treatment of textile yarns or the like, comprising a hollow tubular body at least a portion of which consists of synthetic plastic material and at least a portion of which is elastically deformable in the axial and radial directions of said body without appreciable changes in the configuration of the internal surface of said body, said body having at least one first group and at least one second group of substantially circumferentially extending sections, said groups being adjacent each other, as considered in the axial direction of said body, the sections of each of said groups including a larger-diameter portion and a smaller-diameter portion and the diameters of the larger-diameter portions of said first group exceeding the diameters of the larger-diameter portions of said second group.

6. A bobbin as defined in claim 5, wherein said tubular body has a first end and a second end and includes at least two first groups of sections, one at each end of said tubular body.

7. A bobbin, particularly for heat- and/or wet-treatment of textile yarns or the like, comprising a hollow tubular body at least a portion of which consists of synthetic plastic material and at least a portion of which is elastically deformable in the axial and radial directions of said body without appreciable changes in the configuration of the internal surface of said body, said body having a plurality of substantially circumferentially extending sections including larger-diameter portions, smaller-diameter portions alternating with said larger-diameter portions, as considered in the axial direction of said body, third portions surrounded by said larger-diameter portions, and fourth portions surrounded by said smaller-diameter portions.

8. A bobbin, particularly for heat- and/or wet-treatment of textile yarns or the like, comprising a hollow tubular body at least a portion of which consists of synthetic plastic material and at least a portion of which is elastically deformable in the radial and axial directions thereof without appreciable changes in the configuration of the internal surface of said hollow body, said body having substantially circumferentially extending and substantially circumferentially complete alternating abutting larger-diameter and smaller-diameter sections, said larger-diameter sections constituting the convolutions of a helix and said smaller-diameter sections including means for connecting neighboring larger-diameter sections to each other, said connecting means including welds.

9. A bobbin, particularly for head- and/or wet-treatment of textile yarns or the like, comprising a hollow tubular body at least a portion of which consists of synthetic plastic material and at least a portion of which is elastically deformable in the radial and axial directions thereof without appreciable changes in the configuration of the internal surface of said hollow body, said body having substantially circumferentially extending and substantially circumferentially complete alternating abutting larger-diameter and smaller-diameter sections, said larger-diameter sections constituting the convolutions of a helix and said smaller-diameter sections including means for connecting neighboring larger-diameter sections to each other, said connecting means forming at least one row extending in substantial parallelism with the axis of said tubular body.

10. A bobbin, particularly for heat- and/or wet-treatment of textile yarns or the like, comprising a hollow tubular body which is permeable to liquids and at least a portion of which is elastically deformable in the radial and axial directions thereof without appreciable changes in the configuration of the internal surface of said hollow body, said body having a portion which consists of plastic foam and said body further having substantially circumferentially extending and substantially circumferentially complete alternating abutting larger-diameter and smaller-diameter sections.

11. A bobbin for heat- and/or wet-treatment of textile yarns or the like, comprising a hollow liquid-permeable tubular body at least a portion of which consists of synthetic plastic material and at least a portion of which is deformable in radial and axial directions thereof without appreciable changes in the configuration of the internal surface of said hollow body, said body having substantially circumferentially extending and substantially circumferentially complete alternating abutting larger-diameter and smaller-diameter sections, and means for preventing appreciable changes in the inner diameter of said tubular body in response to radial or axial deformation.

12. A bobbin as defined in claim 11, wherein said means includes a rigid core which is surrounded by said smaller-diameter and larger-diameter sections.

13. A bobbin for heat- and/or wet-treatment of textile yarns or the like, comprising a hollow liquid-permeable tubular body at least a portion of which consists of synthetic plastic material and at least a portion of which is elastically deformable in radial and axial directions thereof without appreciable changes in the configuration of the internal surface of said hollow body, said body having substantially circumferentially extending and substantially circumferentially complete alternating abutting larger-diameter and smaller-diameter sections, said larger-diameter sections being discrete hollow rings.

14. A bobbin as defined in claim 13, wherein said smaller-diameter sections are webs connecting the neighboring hollow rings to each other.

15. A bobbin as defined in claim 13, wherein at least some of said hollow rings have a polygonal cross-sectional outline.

16. A bobbin as defined in claim 13, wherein at least some of said hollow rings have a substantially circular cross-sectional outline.

17. A bobbin for heat- and/or wet-treatment of textile yarns or the like, comprising a hollow liquid-permeable tubular body at least a portion of which consists of synthetic plastic material and at least a portion of which is elastically deformable in radial and axial directions thereof without appreciable changes in the configuration of the internal surface of said hollow body, said body having substantially circumferentially extending and substantially circumferentially complete alternating abutting larger-diameter and smaller-diameter sections, said larger-diameter sections constituting the convolutions of a helix.

18. A bobbin as defined in claim 17, wherein said larger-diameter sections are tubes.

19. A bobbin as defined in claim 17, wherein said smaller-diameter sections include means for connecting neighboring larger-diameter sections to each other.

* * * * *